US007810688B2

(12) United States Patent
Wu et al.

(10) Patent No.: US 7,810,688 B2
(45) Date of Patent: Oct. 12, 2010

(54) NAIL GUN SWITCH MECHANISM

(75) Inventors: Yi-Tsung Wu, Taipei Hsien (TW); Steven Wynne Cole, Jr., Lombard, IL (US)

(73) Assignees: De Poan Pneumatic Corp., Taipei (TW); Robert Bosch Tool Corporation, Mount Prospect, IL (US)

( * ) Notice: Subject to any disclaimer, the term of this patent is extended or adjusted under 35 U.S.C. 154(b) by 223 days.

(21) Appl. No.: 11/962,176

(22) Filed: Dec. 21, 2007

(65) Prior Publication Data

US 2009/0159633 A1 Jun. 25, 2009

(51) Int. Cl.
*B25C 1/04* (2006.01)

(52) U.S. Cl. ..... 227/8; 227/130; 227/142; 227/120

(58) Field of Classification Search ..... 227/8, 227/130, 142, 120
See application file for complete search history.

(56) References Cited

U.S. PATENT DOCUMENTS 4,629,106 A * 12/1986 Howard et al. ..... 227/8
5,083,694 A * 1/1992 Lemos ..... 227/8
5,366,132 A * 11/1994 Simonelli ..... 227/8
5,785,228 A * 7/1998 Fa et al. ..... 227/8
5,791,545 A * 8/1998 Lin ..... 227/8
6,059,161 A * 5/2000 Chang et al. ..... 227/8
6,116,488 A * 9/2000 Lee ..... 227/8
6,860,416 B1 * 3/2005 Chen ..... 227/8
7,070,080 B2 * 7/2006 Lin ..... 227/8
7,191,927 B2 * 3/2007 Segura ..... 227/8
7,322,426 B2 * 1/2008 Aguirre et al. ..... 173/1
7,458,492 B2 * 12/2008 Terrell et al. ..... 227/8
7,464,843 B2 * 12/2008 Huang ..... 227/8
7,527,184 B2 * 5/2009 Shao ..... 227/8
7,530,482 B1 * 5/2009 Ho ..... 227/8
2005/0045688 A1 * 3/2005 Chen ..... 227/8
2005/0184120 A1 8/2005 Terrell et al.
2006/0213947 A1 * 9/2006 Bo-Seob et al. ..... 227/8
2006/0255086 A1 * 11/2006 Aguirre et al. ..... 227/8
2007/0251966 A1 * 11/2007 Wen ..... 227/8
2009/0108046 A1 * 4/2009 Huang ..... 227/8

* cited by examiner

*Primary Examiner*—Rinaldi I. Rada
*Assistant Examiner*—Michelle Lopez
(74) *Attorney, Agent, or Firm*—Chun-Ming Shih

(57) ABSTRACT

A nail gun switch mechanism includes a gun body and a trigger. A safety slidable bar has a bottom part which extends outside of a hitting mouth at a bottom of the gun body. The trigger has a trigger lever being pivotably disposed therein. A top part of the safety slidable bar extends near to an end of the trigger and a swing arm is pivotably disposed on the top part of the safety slidable bar. The swing arm includes an arm part extending from a pivotal center of the swing arm and a push part extending from the arm part toward outside. The push part is configured to be switched to a first or a second swing position and thus driven by the safety slidable bar to touch the trigger lever so as to operate the nail gun in a sequential or a contact actuation mode.

6 Claims, 12 Drawing Sheets

NAIL GUN SWITCH MECHANISM

BACKGROUND

The present invention relates to a nail gun switch mechanism, and particularly to a nail gun switch mechanism for switching the nail gun operation in a sequential actuation mode and a contact actuation mode.

In pneumatic nail guns, a hitting bar is driven by compressed air momentarily to push a nail into a workpiece. The hitting bar is controlled cooperatively by a trigger and a safety slidable bar on the nail gun body or a hitting base connected with the safety slidable bar.

Actuating nails for a pneumatic nail gun generally can be divided into two kinds, one is the sequential actuation mode (or the restrictive mode) and the other is the contact actuation mode.

The sequential actuation mode means the operator firstly should set a safety slidable bar or a hitting base on the safety slidable bar contacting on a workpiece to push an upward movement of a trigger lever, and then press a trigger to bring the trigger lever to actuate a trigger valve. In this mode, if the operator wants to actuate again, he should release the trigger first, and then repeat the above actuation processes. If the operator disobeys the operating sequence, i.e. first pressing the trigger and then pressing the safety slidable bar or the hitting base of the safety slidable bar, the trigger lever in the trigger can not be brought to actuate the trigger valve and nails in the nail gun is held to be driven. Thus, no dangerous accidental shot happens when the safety slidable bar or the hitting base of the safety slidable bar is wrongly touched by somebody.

The contact actuation mode means the operator should first continuously press the trigger, and then move the safety slidable bar or the hitting base of the safety slidable bar on the workpiece to perform continuously contact hitting, which makes the trigger lever brought to upwardly move and actuates the trigger valve to continuous shot. In addition, the contact actuation mode also allows the operator first sets the safety slidable bar or the hitting base of the safety slidable bar on the workpiece to bring the trigger lever to upwardly move, and then individually or continuously presses the trigger to respectively actuate single or multiple nails for fastening the workpiece.

These two actuation modes are both used in a nail gun by utilizing a switch mechanism to realize switching of the sequential actuation mode and the contact actuation mode. As shown in U.S. Pub. No. 20050184120, a rotating rod is included in a contact safety assembly, which is constructed to slide toward/away from a driver housing. The rotating rod includes a first shoulder or ledge and a second shoulder, which is off-set from the first shoulder. The rod may be rotated (not swung) to orientate a selected shoulder to touch a trigger lever in the trigger so as to permit selection between a contact actuation mode and a sequential actuation mode. However by having the two shoulders respectively touch the trigger lever during actuation mode switching, the rotating rod generally has a complicated structure, which needs to be improved.

BRIEF SUMMARY

To overcome the above-mentioned problems, an objective of the present invention is to provide a nail gun switching mechanism in which a single touching surface can be swung between two positions to respectively touch a trigger lever so as to simplify the structure of the nail gun switching mechanism.

An example nail gun switch mechanism of the present invention includes a gun body and a trigger. The gun body has a trigger valve being disposed therein and a safety slidable bar being slidably disposed on. The safety slidable bar has a bottom part, which extends outside of a hitting mouth at a bottom of the gun body. The trigger has a trigger lever being pivotably disposed therein, which is configured for driving the trigger valve to open. A top part of the safety slidable bar extends near to an end of the trigger and a swing arm is pivotably disposed on the top part of the safety slidable bar. The swing arm includes an arm part extending from a pivotal center of the swing arm and a push part extending from the arm part toward outside. The push part is configured to be switched to a first swing position and thus driven by the safety slidable bar to touch the trigger lever so as to operate the nail gun in a sequential actuation mode. The push part is configured to be switched to the second swing position and thus driven by the safety slidable bar to touch the trigger lever so as to operate the nail gun in a contact actuation mode.

In this embodiment, the structure of the swing arm is simpler compared with the rotation rod in the related art while maintaining the capability of switching between different actuation modes. Hence the present invention is suitable for rapid mass production.

According to another embodiment of the present invention, a top part of the safety slidable bar extends near to an end of the trigger and forms a push member. The push member is configured to be driven by the safety slidable bar and thereby to push the trigger lever so as to operate a nail gun in a sequential actuation mode. In addition, the push part in this embodiment is far away from the trigger lever while at the first swing position.

In further embodiments, the top part of the safety slidable bar has a pivotal base disposed thereon. The pivotal base has at least a side board. The swing arm is pivotably disposed on the at least a side board.

In further embodiments, the swing arm has at least a protruding rod on at least an end thereof and the at least a side board has a first through hole and a second through hole. The first through hole is configured to be inserted through by the at least a protruding rod so as to position the push part at the first swing position. The second through hole is configured to be inserted through by the at least a protruding rod so as to position the push part at the second swing position.

In further embodiments, the swing arm has an elastic member disposed thereon. The elastic member is configured for driving the at least a protruding rod to insert through the first through hole or the second through hole. The swing arm has a knob disposed on a pivotal axial center thereof. The knob is configured for driving the at least a protruding rod to be disengaged with the first through hole or the second through hole and for swinging the swing arm so as to switch the swing position of the push part.

In further embodiments, the swing arm has a protruding rod at least an end thereof and the side board has a gliding groove configured for guiding the protruding rod to move and limiting the push part to swinging between the first swing position and the second swing position.

In further embodiments, the swing arm has a knob disposed on a pivotal axial center thereof. The knob is configured for engaging the protruding rod into the gliding groove and pushing the swing arm to drive the protruding rod to move within the gliding groove.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
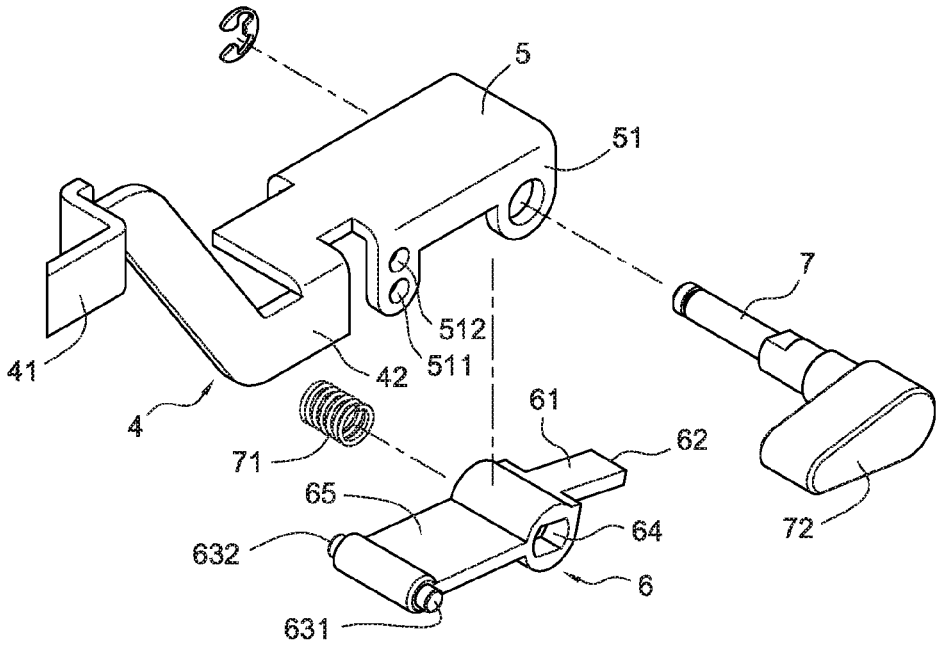
FIG. 1 is an exploded perspective view of a nail gun switch mechanism according to a first embodiment of the present invention.
Figure 2:
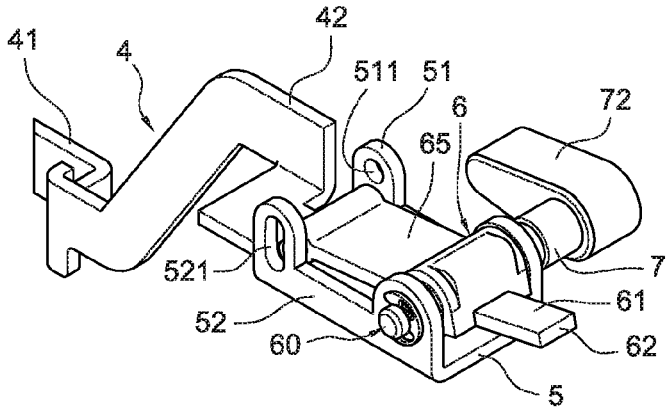
FIG. 2 is a perspective view of the nail gun switch mechanism in FIG. 1.
Figure 3:
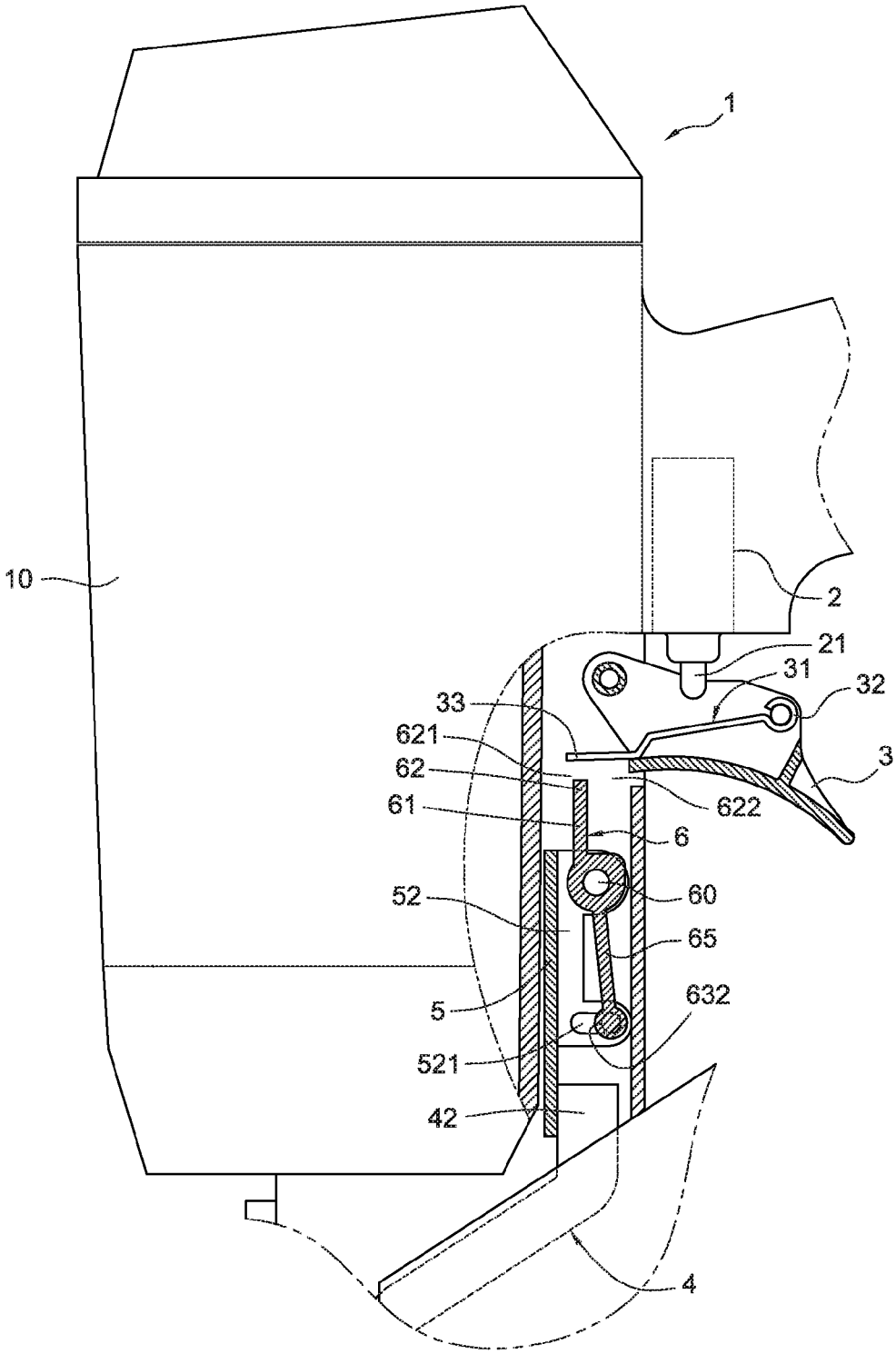
FIG. 3 is a side cross-sectional view of the nail gun switch mechanism in FIG. 1.

FIGS. 1 to 3 disclose a nail gun switch mechanism according to a first embodiment of the present invention. A nail gun 1 has a gun body 10 and a trigger 3. A trigger valve 2 is disposed in the gun body 10. A trigger lever 31 is pivotably disposed in the trigger 3 configured for driving the trigger valve 2 to open. A safety slidable bar 4 is slidably disposed on the gun body 10. A bottom part 41 of the safety slidable bar 4 extends to the outside of a hitting mouth at a bottom of the gun body 10. A top part 42 of the safety slidable bar 4 extends near to an end of the trigger 3.

Figure 8:
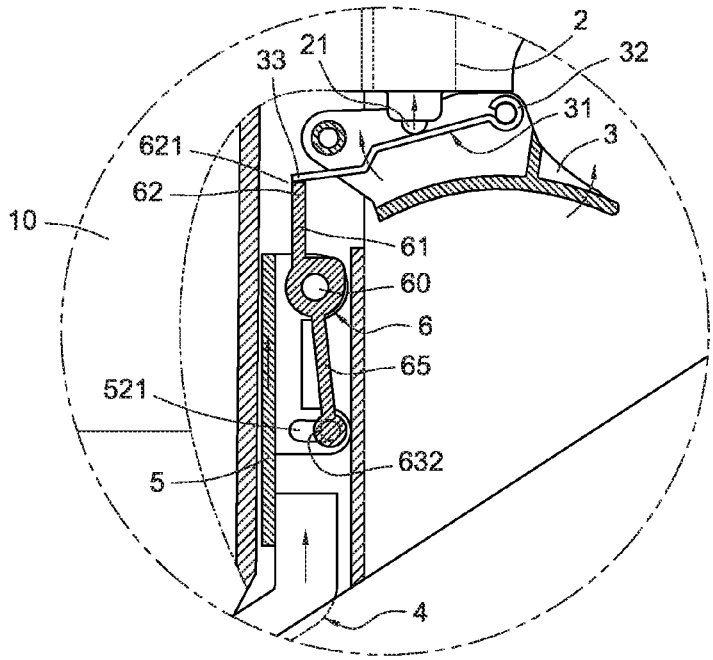
FIG. 8 is a schematic view of the nail gun switch mechanism in FIG. 1 in a working status.

The trigger lever 31 has a pivot base 32 (as shown in FIG. 3) at one end pivotally disposed on the sidewalls of the trigger 3, and a tongue part 33 at another end. When the tongue part 33 and the pivot base 32 of the trigger lever 4 are pushed or brought to move upwardly (as shown in FIG. 8), an intermediate portion of the trigger lever 31 can push the trigger valve bar 21 so as to drive the trigger valve 2 to open. The safety slidable bar 4 has a bend shape (as shown in FIG. 1 to FIG. 5). The bottom part 41 is connected with a hitting base, the hitting base being configured for pushing a surface of the workpiece, and extends out from the hitting mouth.

In this embodiment, referring to FIG. 1 to FIG. 5, a swing arm 6 is pivotably disposed on the top part 42 of the safety slidable bar 4. The swing arm 6 includes an arm part 61 extending from a pivotal center 60 of the swing arm 6 and a push part 62 extending from the arm part 61. The push part 62 can be switched between a first swing position 621 and a second swing position 622, as shown in FIG. 3 to FIG. 7. At the first swing position 621, the push part 62 can be driven by the safety slidable bar 4 and touch the tongue part 33 of the trigger lever 31. At the second swing position 622, the push part 62 can also be driven by the safety slidable bar 4 and touch the tongue part 33 of the trigger lever 31.

Figure 10:
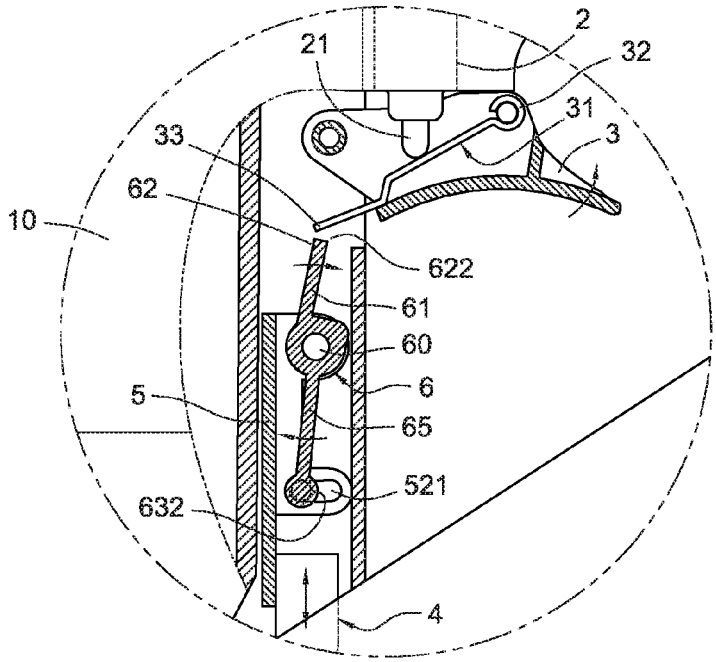
FIG. 10 is a schematic view of the nail gun switch mechanism in FIG. 1 in yet another working status.

When the trigger 3 is not pulled, as shown in FIG. 3, and the push part 62 is at the first swing position 621, the push part 62 can move upward and touch the tongue part 33 of the trigger lever 31. When the trigger 3 is pulled, as shown in FIG. 10, and the push part 62 is at the second swing position 622, the push part 62 can move upward and touch the tongue part 33 of the trigger lever 31.

Figure 6:
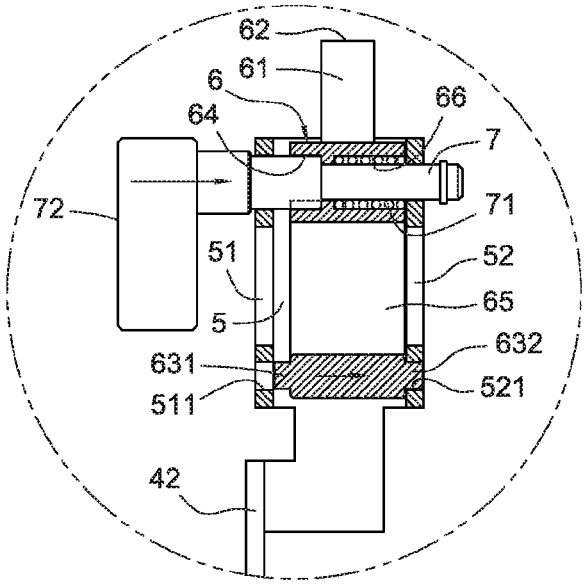
FIG. 6 is a partially enlarged view of the nail gun switch mechanism in FIG. 4.

More specifically, referring to FIG. 1 and FIG. 6, an axial hole 64 is formed in an intermediate portion of the swing arm 6. An axial bar 7 is inserted through the axial hole 6 and serves as an axial center of the swing arm 60 so as to pivotably dispose the swing arm 6 on the top pat 42 of the safety slidable bar 4.

Referring to FIG. 1 to FIG. 7, a pivotal base 5 is formed along with the top part 42 of the safety slidable bar 4. At least a side board is formed on the pivotal base 5. In this embodiment, there are a first side board 51 and a second side board 52, in between which the swing arm 6 is pivotably disposed.

Figure 7:
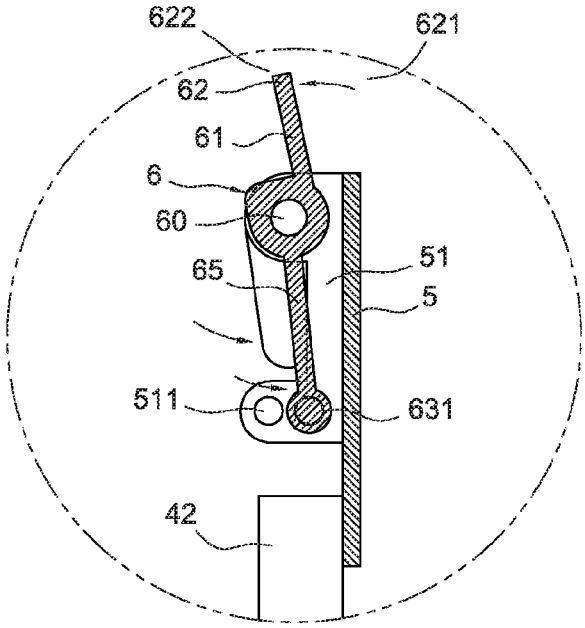
FIG. 7 is a partially enlarged view of the nail gun switch mechanism in FIG. 5.

The swing arm 6 has at least a protruding rod on at least an end thereof. The side boards have a first through hole 511 and a second through hole 512 formed thereon, referring to FIG. 1, FIG. 4 and FIG. 5). In this embodiment, a first protruding rod 631 and a second protruding rod 632 are respectively formed on two sides of the swing arm 6, as shown in FIG. 1. The first through hole 511 and the second through hole 512 are formed on the first side board 51. Referring to FIG. 5 and FIG. 8, the first protruding rod 631 can be inserted into the first through hole 511 so as to position the push part 62 at the first swing position 621. Referring to FIG. 7 and FIG. 10, the first protruding rod 631 can also be inserted into the second through hole 512 so as to position the push part 62 at the second swing position 622.

The first and second protruding rods 631 and 632 are in fact formed on two sides of a tail board 65 extending from a pivotal center 60 of the swing arm 6. The pivotal center 60 is between the protruding rods 631 and 632 and the push part 62.

The swing arm 6 has an elastic member 71 disposed thereon. A spring groove 66 with a relative large radius is formed at an end of the axial hole 64 of the swing arm 6. The elastic member 71 is a spring holding the axial bar 7 and disposed between the spring groove 66 and the second side board 52. The elastic member 7 is configured for driving the swing arm 6 to transversely move toward the first side board 51 so as to move the first protruding rod 631 into the first or second through hole 511 or 512. The swing arm 6 can thereby elastically move between the first and second side board 51 and 52.

Figure 4:
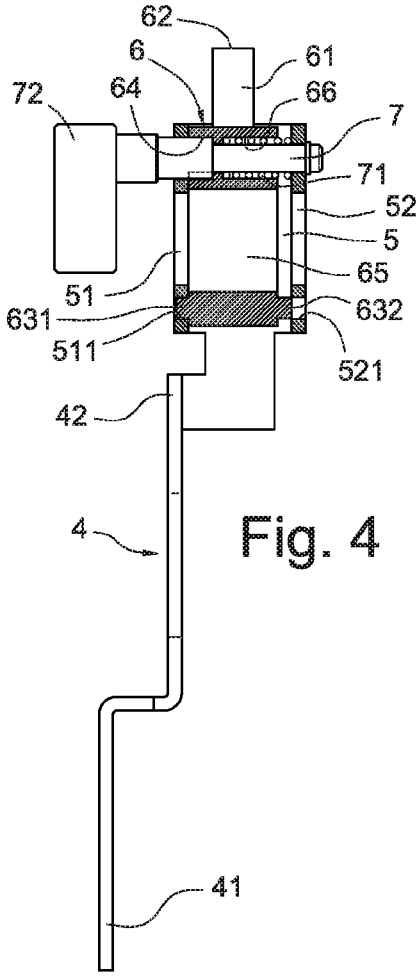
FIG. 4 is a front cross-sectional view of the nail gun switch mechanism in FIG. 2.
Figure 5:
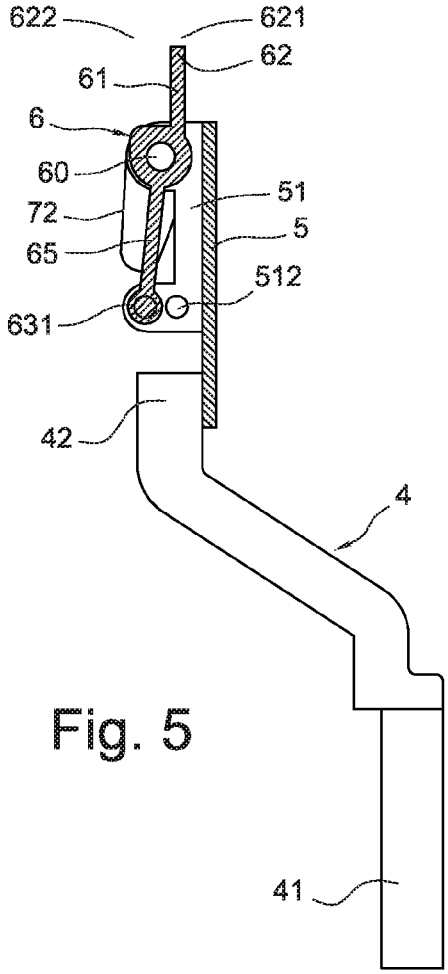
FIG. 5 is a side cross-sectional view of the nail gun switch mechanism in FIG. 2.

The axial bar 7 has a knob 72 at an end thereof, as shown in FIG. 1, FIG. 2 and FIG. 4. By pushing the knob 72 the elastic force from the elastic member 7 is overcome so that the swing arm 6 is moved toward the second side board 52, as shown in FIG. 6. As a result, referring to FIG. 5 and FIG. 7, the first protruding rod 631 is disengaged with the first or second through hole 511 or 512 and the arm part 61 can swing so as to switch the swing position of the push part 62 controlled by the knob 72. When the knob 72 is released, the elastic member 71 drives the swing arm to transversely move toward the first side board 51 and again move the first protruding rods 631 into the first or second through hole 511 or 512.

Referring to FIG. 2, FIG. 3 and FIG. 4, a gliding grove 521 is formed on the side boards. In this embodiment, the gliding groove is formed on the second side board 52. When the knob 72 is pushed, it drives the second protruding rod 632 to embed in the gliding groove 521, as shown in FIG. 6. When the knob is turned, the swing arm is driven to swing, as shown in FIG. 10, and drives the second protruding rod 632 to move along the gliding groove 521 so that the push part 62 swings while being confined between the first swing position 621 and the second swing position 622.

According to the aforementioned structure, the operation of this embodiment is described as follows.

To set up the pneumatic nail gun in a sequential actuation mode, the operator can push, turn, and release the knob 72 (as shown in FIG. 6) so as to switch the push part 62 to the first swing position 621 (as shown in FIG. 8). At this moment, the operator may push the bottom part 41 of the safety slidable bar 4 upon a workpiece, which makes the safety slidable bar 4 move upwards (as shown in FIG. 6) and bring the swing arm 6 to move upwards so that the push part 62 pushes the tongue part 33 of the trigger lever 31 to move upwards. After that, the operator can pull the trigger 3 to bring an upward movement to the pivotal part 32 of the trigger lever 31, which brings the trigger lever 31 to move upwards to push the trigger valve bar 21 of the trigger valve 2 so as to drive the hitting bar in the gun body 10 to hit a nail for once in a sequential actuation mode.

Figure 9:
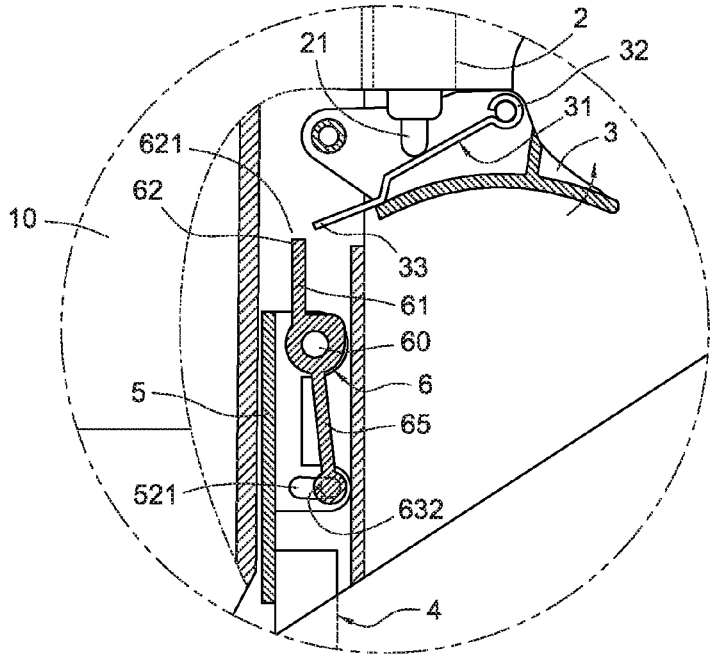
FIG. 9 is a schematic view of the nail gun switch mechanism in FIG. 1 in another working status.

In addition, if the operator makes a mistake by pulling the trigger 3 first accidentally, referring to FIG. 9, and then pushing the hitting base or the safety slidable bar 4 to bring the swing arm 6 to drive the push part 62 to move upwards, unintended nail shooting can be prevented by the fact that the pulled trigger 3 has moved the trigger lever 31 already which disengaged the tongue part 33 from a position where it can be touched by the upwardly moving push part 62 so that the tongue part 33 can not push the trigger valve bar 21 of the trigger valve 2 and initiate nail shooting. As a result, the above mentioned sequential actuation mode is relatively safe.

To set up the pneumatic nail gun in a contact actuation mode, the operator can push, turn, and release the knob 72 (as shown in FIG. 6) so as to switch the push part 62 to the second swing position 622 (as shown in FIG. 7 and FIG. 10). At this moment, the operator may pull the trigger 3 all the way down to the bottom so as to move the pivotal part 32 of the trigger lever 31 upwards, and then push the hitting base of the bottom part 41 of the safety slidable bar 4 upon a workpiece so that the hitting base drives the safety slidable bar 4, the pivotal base 5 and the swing arm 6 to move upwards, which in turn makes the push part 62 move upwards to push the tongue part 33 of the trigger lever 31 to move upwards. As a result, the whole trigger lever 31 moves up and pushes the trigger valve bar 21 of the trigger valve 2 so as to drive the hitting bar in the gun body 10 to initiate nail shooting in a contact actuation mode. In this mode, the operator can pull and hold the trigger 3 and repeatedly pushing and releasing the hitting base upon the workpiece, so that the tongue part 33 of the trigger lever 31 is repeatedly pushed by the push part 62 and continuous nail shooting in the contact actuation mode is realized.

Figure 11:
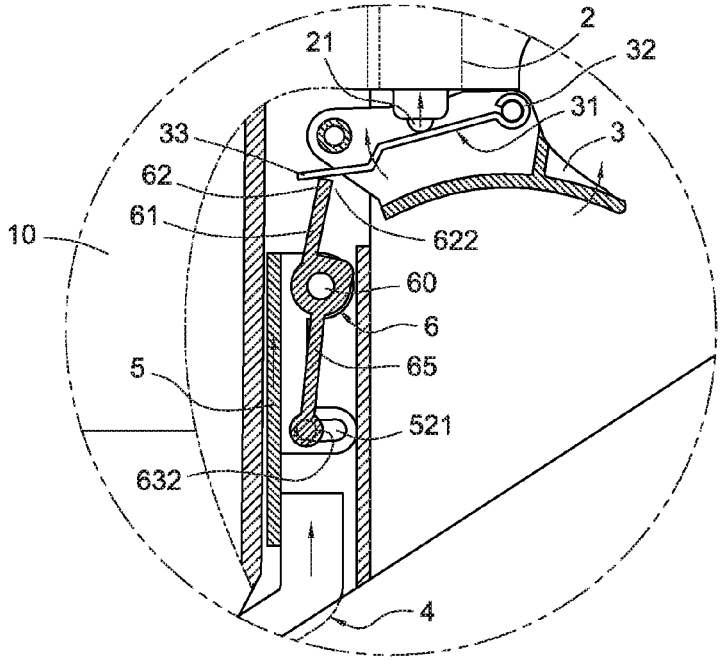
FIG. 11 is a schematic view of the nail gun switch mechanism in FIG. 1 in still another working status.

In addition, in the contact actuation mode, the operator is allowed to first push the hitting base upon the workpiece so as to drive the safety slidable bar 4, the pivotal base 5 and the swing arm 6 to move upwards, as shown in FIG. 11 so that the push part 62 moves upwards to push the tongue part 33 of the trigger lever 31 to move upwards. Then the operator may pull the trigger 3 for once or for continuous multiple times so as to shoot single or multiple nails onto the workpiece.

In the above embodiment, the swing arm 6 is used to control a single push part 62 to switch between the first swing position 621 and the second swing position 622 where the push part 62 can respectively touch the tongue part 33 of the trigger lever 31. The structure of the swing arm 6 is simpler compared with the rotation rod in the related art while maintaining the capability of switching between different actuation modes. With the present invention, the manufacturing efficiency is improved and the manufacturing cost is reduced, which makes the present invention suitable for rapid mass production.

Figure 12:
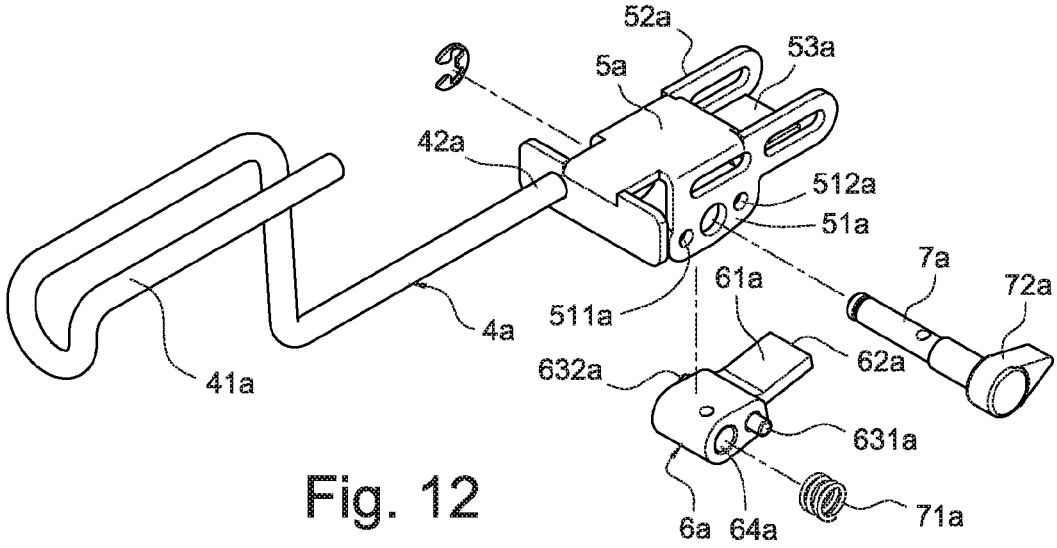
FIG. 12 is an exploded perspective view of a nail gun switch mechanism according to a second embodiment of the present invention.
Figure 13:
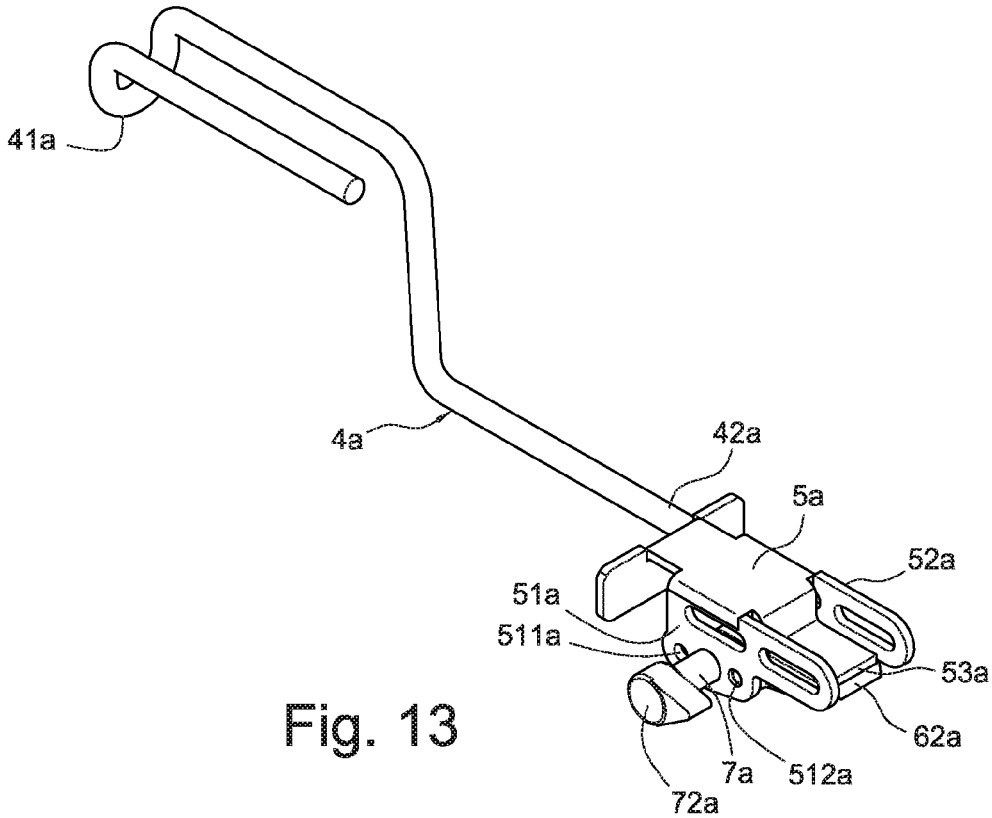
FIG. 13 is a perspective view of the nail gun switch mechanism in FIG. 12.
Figure 14:
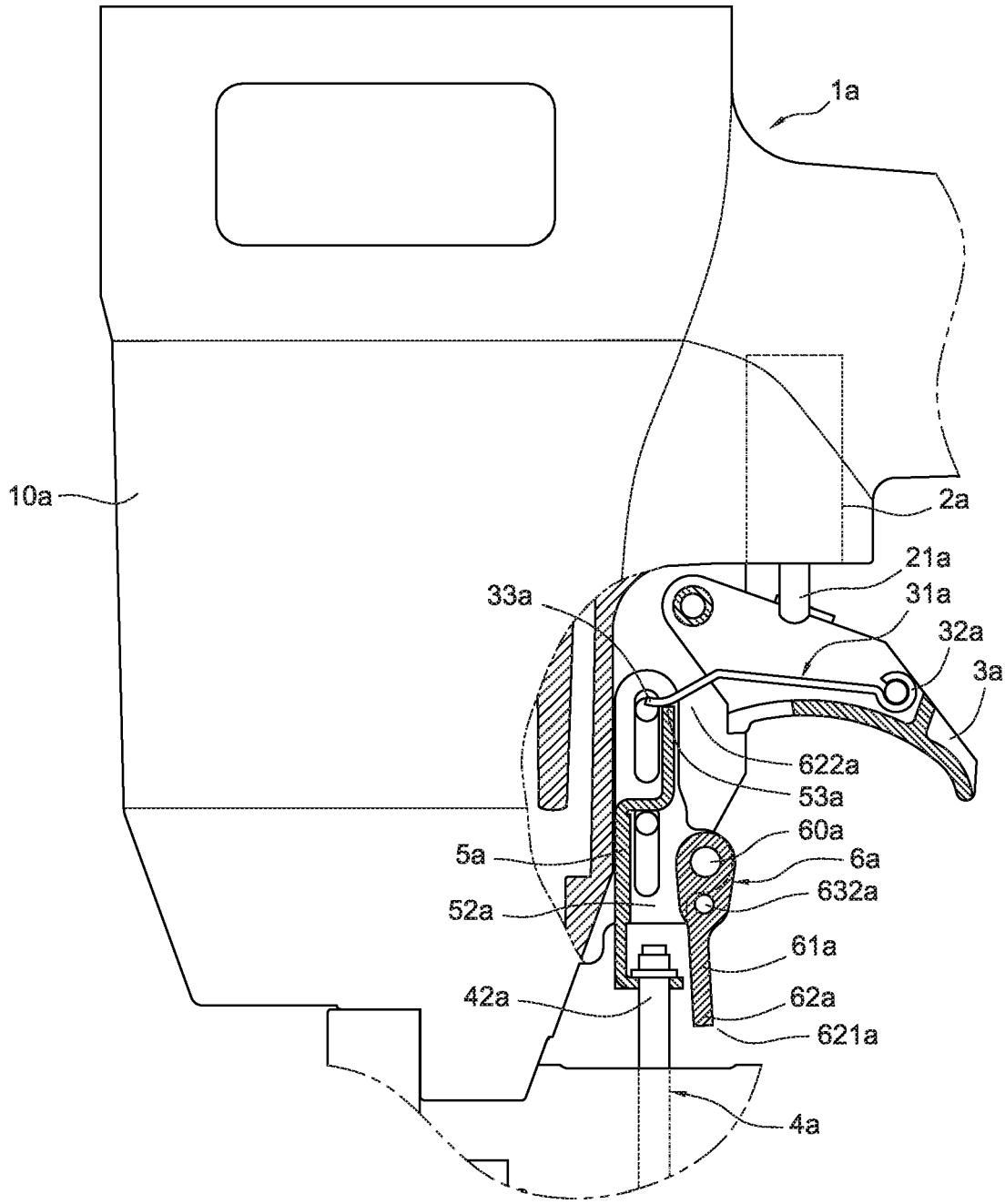
FIG. 14 is a side cross-sectional view of the nail gun switch mechanism in FIG. 12.
Figure 15:
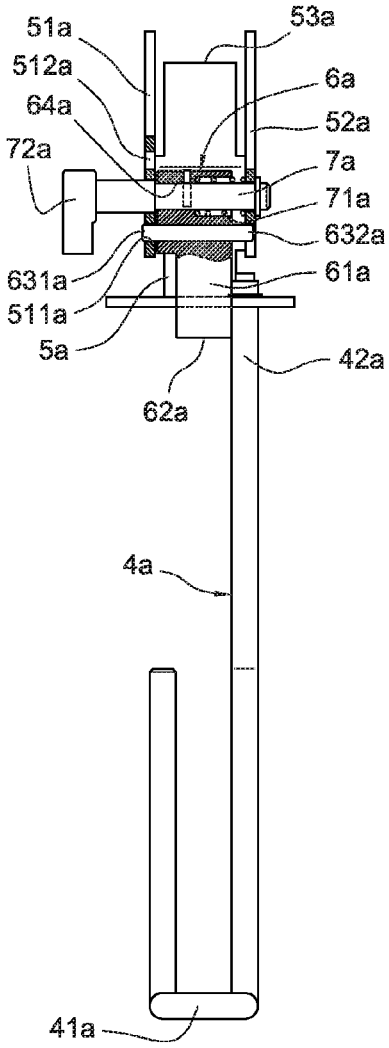
FIG. 15 is a front cross-sectional view of the nail gun switch mechanism in FIG. 13.
Figure 16:
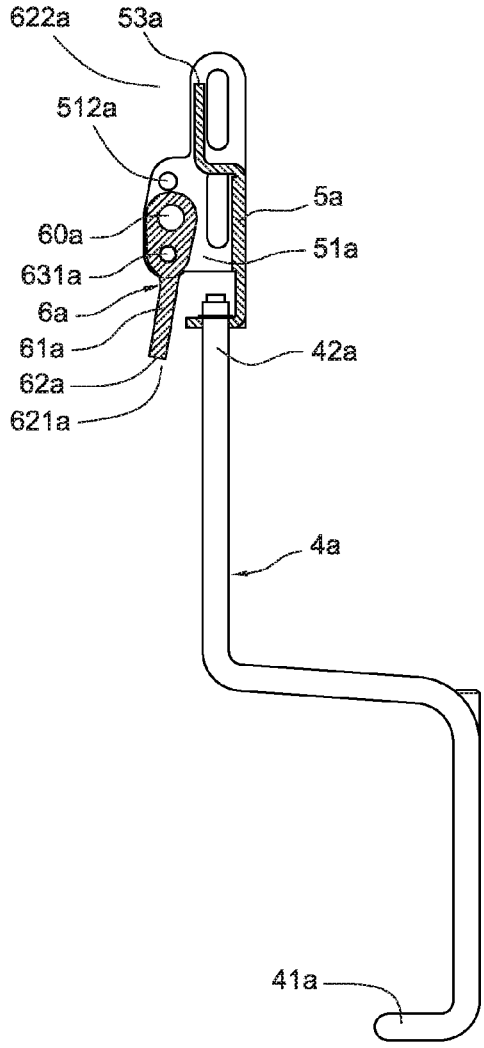
FIG. 16 is a side cross-sectional view of the nail gun switch mechanism in FIG. 13.
Figure 17:
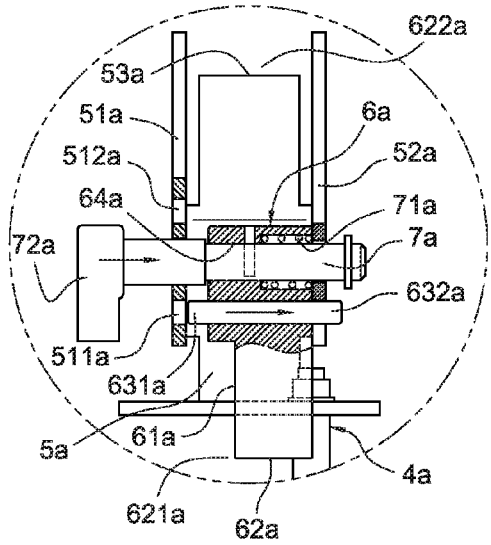
FIG. 17 is a partially enlarged view of the nail gun switch mechanism in FIG. 15.
Figure 18:
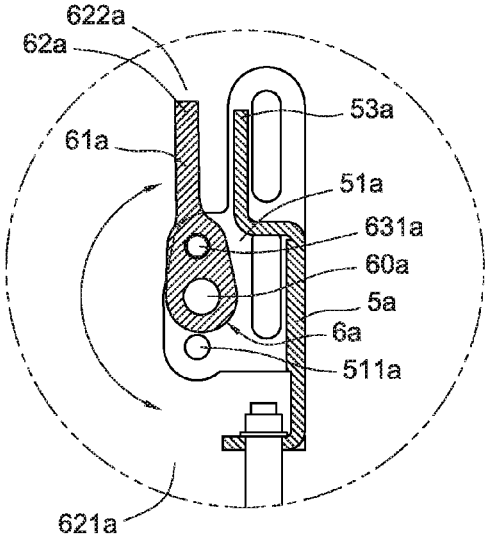
FIG. 18 is a partially enlarged view of the nail gun switch mechanism in FIG. 16.
Figure 20:
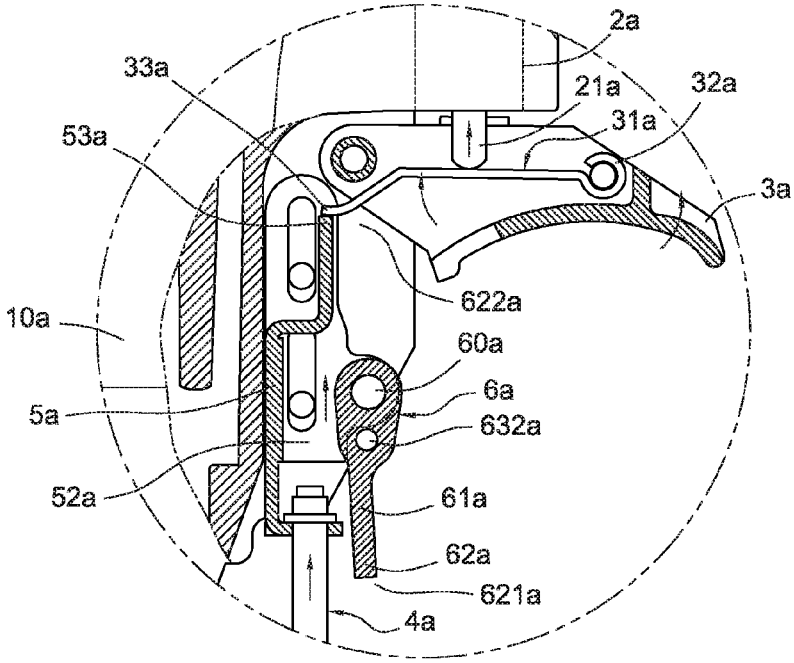
FIG. 20 is a schematic view of the nail gun switch mechanism in FIG. 12 in a working status.

Referring to FIG. 12, a nail gun switch mechanism according to a second embodiment of the present invention is provided. In this embodiment, the top part 42*a* of the safety slidable bar 4*a* can extend near to an end of the trigger 3*a* and thereby form a push member 53*a* configured to be driven by the safety slidable bar 4*a* and touch the tongue part 33*a* of the trigger lever 31*a* (as shown in FIG. 20). When the push part 62*a* is at the first swing position 621*a*, the push part 62*a* is far from the tongue part 33*a* of the trigger lever 31*a*. Hence, both when the trigger 3*a* is pulled and when the trigger 3*a* is not pulled, referring to FIG. 20, the push part 62*a* at the first swing position 621*a* after being driven by the safety slidable bar 4 to move upwards, is not touchable by the tongue art 33*a* of the trigger lever 31*a*. The first and second protruding rod 631*a* and 632*a* are respectively disposed on two sides of the arm part 61*a* of the swing arm 6*a*. The arm part 61*a* is disposed between the axial hole 64*a* and the pushing part 62*a*. The axial hole 64*a* is configured for holding the axial bar 7*a* (shown in FIG. 12). Referring to FIG. 15 to FIG. 18, the first through hole 511*a* is disposed on the first side board 51*a* of the pivotal base 5*a* below the pivotal center 60*a* of the swing arm 6*a*. The second through hole 512*a* is disposed on the first side board 51*a* above the pivotal center 60*a*. The push member 53*a* is formed on the top of the pivotal base 5*a*. In addition, no gliding groove is formed on the second side board 52*a* of the pivotal base 5*a*. The rest components of this embodiment are the same as the first embodiment. If the operator intends to switch the push part 62*a* to the first swing position 621*a* or the second swing position 622*a*, he may press the knob 72*a* so as to overcome the pushing force of the elastic member 71*a* (as shown in FIG. 17), and to drive the swing arm 6*a* to transversely move toward the second side board 52*a*. The first protruding rod is thus disengaged from the first or the second through hole 511*a* or 512*a*. By turning the knob 72*a* the swing arm 61*a* is controlled to swing (as shown in FIG. 18) so as to switch the push part 62*a* to the first or second swing position 621*a* and 622*a*. When the knob 72*a* is released, the elastic member 71*a* again drives the swing arm 6*a* to engage the first protruding rod 631*a* with the first or the second through hole 511*a* or 512*a* so as to position the push part 62*a* to the first or the second swing position 621*a* or 622*a*.

According to the aforementioned structure, the operation of this embodiment is described as follows.

Figure 19:
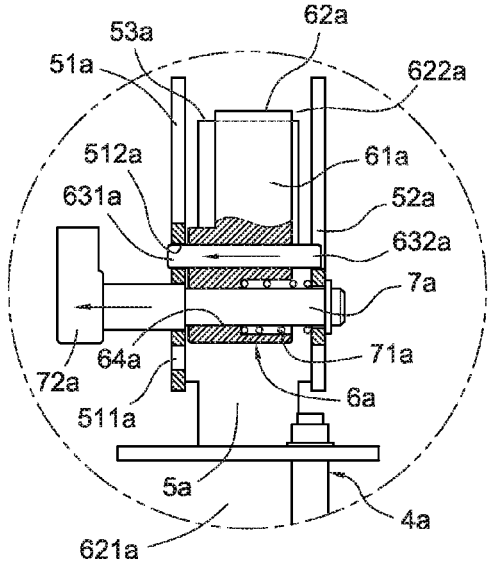
FIG. 19 is another partially enlarged view of the nail gun switch mechanism in FIG. 15.

To set up the pneumatic nail gun in a sequential actuation mode, the operator can push, turn, and release the knob 72*a* (as shown in FIG. 17 to FIG. 19) so as to switch the push part 62*a* to the first swing position 621*a* (as shown in FIG. 20) and push the bottom part 41*a* of the safety slidable bar 4*a* upon a workpiece, which makes the safety slidable bar 4*a*, the pivotal base 5*a* and the push member 53*a* move upwards (as shown in FIG. 6) so that the push member 53*a* moves upwards and pushes the tongue part 33*a* of the trigger lever 31*a* to move upwards. Now, the operator can pull the trigger 3*a* to bring an upward movement to the pivotal part 32*a* of the trigger lever 31*a*, which brings the whole trigger lever 31*a* to move upwards and push the trigger valve bar 21*a* of the trigger valve 2*a* so as to drive the hitting bar in the gun body 10*a* of the nail gun 1*a* to hit a nail for once in a sequential actuation mode.

Figure 21:
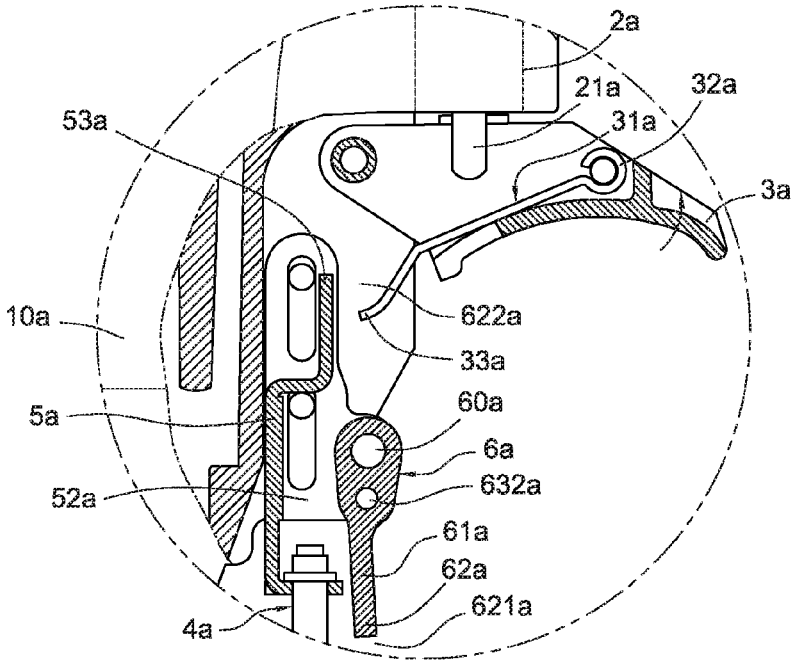
FIG. 21 is a schematic view of the nail gun switch mechanism in FIG. 12 in another working status.

In addition, if the operator makes a mistake by pulling the trigger 3*a* first accidentally, referring to FIG. 21, and then pushing the hitting base or the safety slidable bar 4*a* to drive the pivotal base 5*a* and the push member 53*a* to move upwards, unintended nail shooting can be prevented by the fact that the pulled trigger 3*a* has moved the trigger lever 31 already which disengages the tongue part 33*a* from a position where it can be touched by the upwardly moving push member 53*a* so that the tongue part 33*a* can not be pushed to move upwards. As a result, the above mentioned sequential actuation mode is relatively safe.

Figure 22:
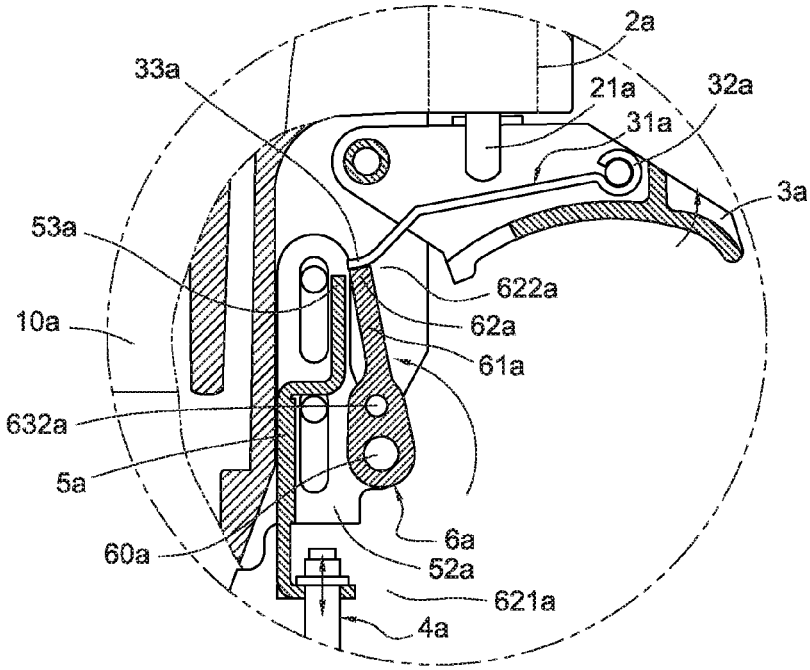
FIG. 22 is a schematic view of the nail gun switch mechanism in FIG. 12 in yet another working status.

To set up the pneumatic nail gun in a contact actuation mode, the operator can push, turn, and release the knob 72*a* (as shown in FIG. 17 to FIG. 19) so as to switch the push part 62*a* to the second swing position 622*a* (as shown in FIG. 22). At this moment, the operator may pull the trigger 3*a* all the way down to the bottom so as to move the pivotal part 32*a* of the trigger lever 31*a* upwards, and then push the hitting base of the safety slidable bar 4*a* upon a workpiece so that the hitting base drives the safety slidable bar 4*a*, the pivotal base 5*a* and the swing arm 6*a* to move upwards, which in turn makes the push part 62*a* move upwards to push the tongue part 33*a* to move upwards. As a result, the whole trigger lever 31*a* moves up and pushes the trigger valve bar 21*a* so as to drive the hitting bar in the gun body 10*a* to initiate nail shooting in a contact actuation mode. In this mode, the operator can pull and hold the trigger 3*a* so as to repeatedly carry out nail shooting on the workpiece in the contact actuation mode.

Figure 23:
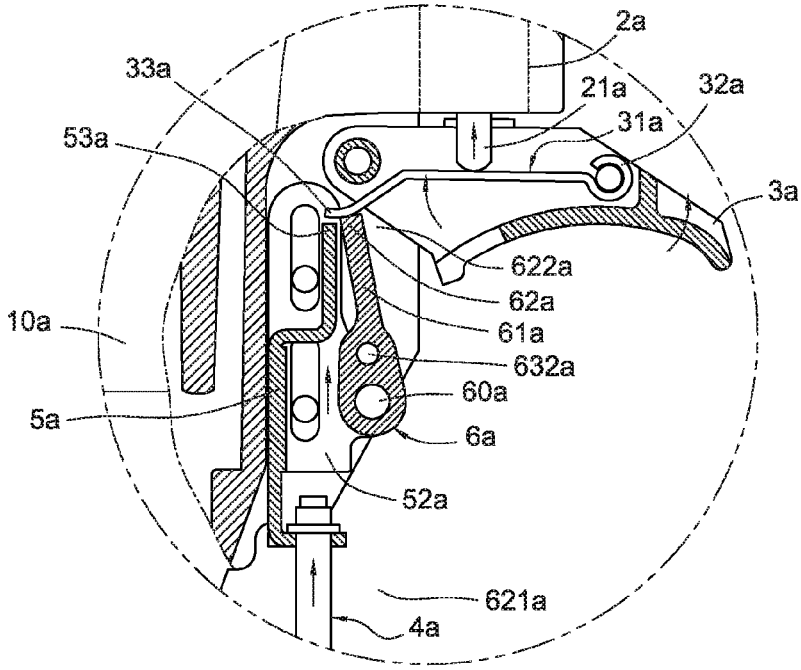
FIG. 23 is a schematic view of the nail gun switch mechanism in FIG. 12 in still another working status.

In addition, in the contact actuation mode, the operator is allowed to first push the hitting base upon the workpiece so as to drive the safety slidable bar 4*a*, the pivotal base 5*a* and the swing arm 6*a* to move upwards, as shown in FIG. 23 so that the push part 62*a* moves upwards to push the tongue part 33*a* to move upwards. Then the operator may pull the trigger 3*a* for once or for continuous multiple times so as to shoot single or multiple nails onto the workpiece.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A nail gun switch mechanism comprising:

a gun body having a trigger valve disposed therein and a safety slidable bar slidably disposed thereon, the safety slidable bar having a bottom part which extends outside of a hitting mouth at a bottom of the gun body; and a trigger having a trigger lever pivotably disposed therein, the trigger lever being configured for driving the trigger valve to open;

a pivotal base disposed on a top part of the safety slidable bar to extend near to an end of the trigger, the pivotal base having at least one side board and a push member configured to be driven by the safety slidable bar to push the trigger lever so as to operate a nail gun in a sequential actuation mode; and a swing arm is pivotably disposed on the at least one side board, the swing arm comprising an arm part extending from a pivotal center of the swing arm and a push part extending from the arm part toward outside, the push part being configured to be switched to a first swing position and a second swing position, the push part being far away from the trigger lever while at the first swing position and being configured to be driven by the safety slidable bar to touch the trigger lever so as to operate the nail gun in a contact actuation mode while at the second swing position.

2. The nail gun switch mechanism as claimed in claim 1, wherein the swing arm has at least one protruding rod on at least one end thereof and the at least one side board has a first through hole and a second through hole, the first through hole being configured to be inserted through by the at least one protruding rod so as to position the push part at the first swing position, the second through hole being configured to be inserted through by the at least one protruding rod so as to position the push part at the second swing position.

3. The nail gun switch mechanism as claimed in claim 2, wherein the swing arm has an elastic member disposed thereon, the elastic member being configured for driving the at least one protruding rod to insert through the first through hole or the second through hole.

4. The nail gun switch mechanism as claimed in claim 2, wherein the swing arm has a knob disposed on an pivotal axial center thereof, the knob being configured for driving the at least one protruding rod to be disengaged with the first through hole or the second through hole and for swinging the swing arm so as to switch the swing position of the push part.

5. The nail gun switch mechanism as claimed in claim 1, wherein the swing arm has a protruding rod at at least one end thereof and the side board has a gliding groove configured for guiding the protruding rod to move and limiting the push part to swing between the first swing position and the second swing position.

6. The nail gun switch mechanism as claimed in claim 5, wherein the swing arm has a knob disposed on a pivotal axial center thereof, the knob being configured for engaging the protruding rod into the gliding groove and pushing the swing arm to drive the protruding rod to move within the gliding groove.

* * * * *